United States Patent [19]

Rynberk

[11] 4,408,717

[45] Oct. 11, 1983

[54] FOUNTAIN CONSTRUCTION WITH LIGHTING MEANS

[75] Inventor: Robert W. Rynberk, Hinsdale, Ill.

[73] Assignee: Valley View Specialties Co., Crestwood, Ill.

[21] Appl. No.: 257,882

[22] Filed: Apr. 27, 1981

[51] Int. Cl.[3] ..... F21P 7/00

[52] U.S. Cl. ..... 239/18

[58] Field of Search ..... 239/18–20

[56] References Cited

U.S. PATENT DOCUMENTS

| | | | |
|---|---|---|---|
| 1,929,825 | 10/1933 | Requa | 239/19 |
| 2,481,054 | 9/1949 | Wendel | 239/18 |
| 2,883,114 | 4/1959 | Horvath | 239/19 |
| 2,958,468 | 11/1960 | Long | 239/20 |
| 3,022,010 | 2/1962 | Barnett | 239/17 |
| 3,858,620 | 1/1975 | Hruby | 239/17 |

*Primary Examiner*—Andres Kashnikow

*Attorney, Agent, or Firm*—McDougall, Hersh & Scott

[57] ABSTRACT

A fountain construction dispenses water in a pond or the like for aesthetic purposes. A feed line is located beneath the water surface, and a vertically extending feed pipe delivers water from the feed line to a dispensing nozzle at the upper end of the feed pipe. A pump having a connection with the feed line delivers the water under pressure. The feed line and associated feed pipe are shaped so that a lamp supporting bracket can be located at the juncture thereof. A lamp supported on the bracket emits a light beam axially relative to the feed pipe and nozzle whereby a particularly pleasing aesthetic effect is realized with minimum detraction from the beauty of the pond or the like resulting from the presence of the hardware in the pond.

2 Claims, 4 Drawing Figures

FOUNTAIN CONSTRUCTION WITH LIGHTING MEANS

BACKGROUND OF THE INVENTION

Water fountain constructions of various types have been developed. Such constructions are typically characterized by pipes disposed beneath the surface of a pond or otherwise in communication with a source of water. A pump is generally employed for feeding water to the pipe and to outlets in the form of nozzles whereby a spray is achieved.

A single nozzle or a plurality of nozzles may be utilized, and since the fountain is generally utilized for aesthetic reasons, the nozzles are positioned for achieving a desirable appearance of the spray.

The most pertinent prior art is comprised of Barnett U.S. Pat. No. 3,022,010 which utilizes a succession of rings and associated nozzles for achieving a spray or fountain effect. A vertical feed pipe and transversely extending pipe connections are employed for delivering water to the fountain rings.

Hruby U.S. Pat. No. 3,858,620 discloses a fountain construction which also employs pipe connections for feeding water to dispensing means. This dispensing means includes a centrally located discharge nozzle.

In addition to utilizing the nozzles to achieve a spray, lamps are often associated with the fountains for additional aesthetic effect. The aforementioned Hruby patent is an example of the prior art usage of such lamps.

BRIEF DESCRIPTION OF THE INVENTION

This invention relates to an improved water fountain construction. In this construction, pump means are utilized for delivering water under pressure through a feed line located under the water, and the water is then forced into a vertically positioned feed pipe having a nozzle means at its upper end to achieve a water spray or fountain effect. The configuration of the dispensing nozzle or nozzles, the location of the nozzles, and the pump pressure are among the factors which will determine the appearance of the spray.

The invention is particularly characterized by means associated with the feed line and cooperating feed pipe for supporting a lamp. The support preferably comprises a bracket located at the juncture of the feed line and feed pipe. The bracket includes means for supporting the lamp in a position so that a light beam is emitted axially relative to the feed pipe and its associated nozzle or nozzles. The feed line and said pipe are specifically designed to achieve this mounting position, and a particularly pleasing aesthetic effect is realized while at the same time, the presence of the hardware in the pond does not detract from the beauty of the pond.

DETAILED DESCRIPTION OF THE INVENTION

Figure 1:
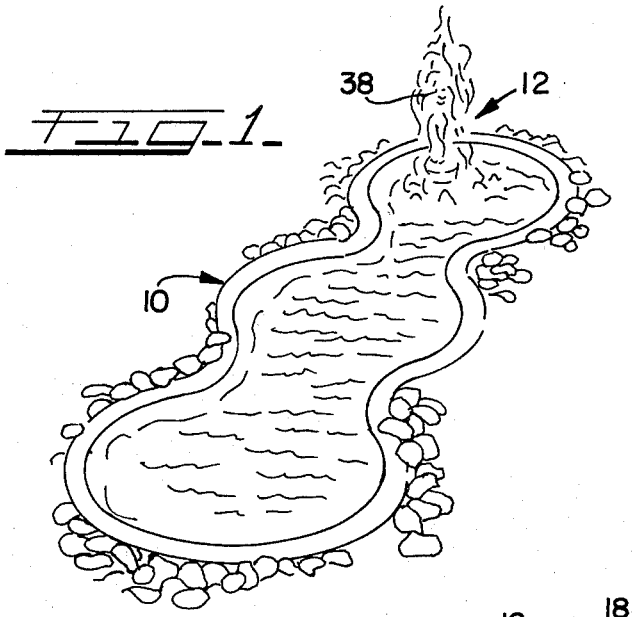
FIG. 1 is a perspective view of a pond having a fountain construction of the type contemplated by this invention associated therewith.
Figure 2:
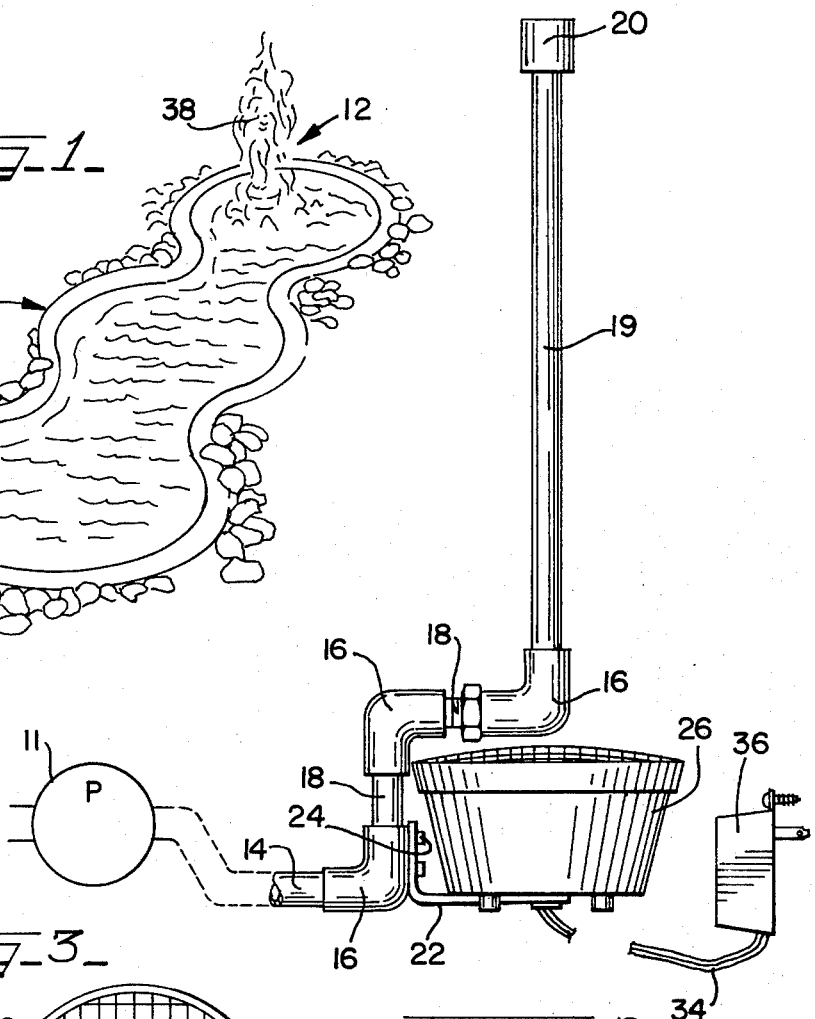
FIG. 2 is a vertical elevational view of the fountain construction.
Figure 3:
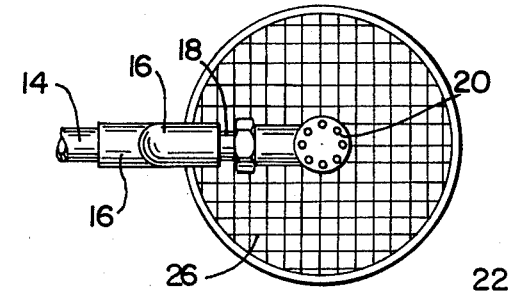
FIG. 3 is a top plan view of the feed pipe and associated lamp shown in FIG. 2; and, FIG. 4 is a bottom plan view of the arrangement of FIG. 3 particularly illustrating the lamp bracket means.
Figure 4:
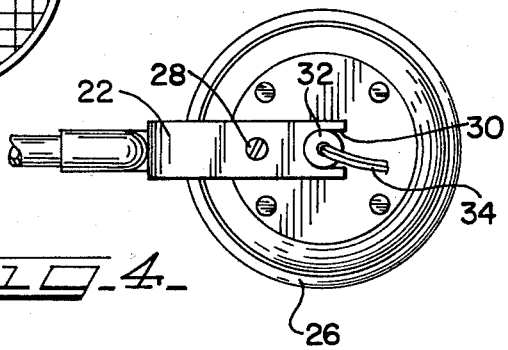

FIG. 1 of the drawings illustrates a pond 10 which may be located in a garden, yard or the like for aesthetic purposes. A water fountain 12 is located in the pond and, in accordance with a typical system of this type, a pump is employed for feeding water under pressure to the fountain. This may comprise a submersible pump also located in the pond whereby the water in the pond is recirculated. On the other hand, a pump located outside the pond and with some other source of water is also contemplated.

The pump is connected to the fountain through a feed line comprising a flexible hose section 14. Elbows 16 and pipe sections 18 serve to connect the hose section to a feed pipe 19. In the embodiment shown, a single pipe 19 is employed and a single nozzle 20 is attached at its upper end. It will be appreciated that two or more vertically extending feed pipes which have respective nozzles or which are connected to a dispensing ring supporting a plurality of nozzles could also be utilized.

A right-angle bracket 22 is secured by means of fasteners 24 to the lowermost elbow 16. The horizontal arm of the bracket 22 supports a housing 26 for a lamp. The lamp is connected to the horizontal bracket arm by means of fastener 28. A notch 30 is defined in the end of the horizontal arm for receiving the mounting washer 32 through which electrical cord 34 extends. This cord has a plug 36 attached thereto which may be connected to any suitable outlet, it being understood that lamps, cords and plugs suitable for use underwater are available and do not form a part of this invention.

As will be observed, the provision of the elbows 16, pipe sections 18 and bracket 22 serves to support the lamp 26 whereby light beams are emitted axially of feed pipe 19. Accordingly, a spray 38 as shown in FIG. 1 will be emitted from nozzle 20 within the beam of the lamp. It has been observed that this provides a highly desirable combination for achieving maximum beauty of the fountain.

It will be appreciated that a fountain configuration is shown only for purposes of illustration since the concepts of the invention could be adopted for a large variety of configurations. It will also be understood that various changes and modifications may be made in the above described construction which provide the characteristics of this invention without departing from the spirit thereof, particularly as defined in the following claims.

That which is claimed is:

1. In a water fountain construction for creating a spray of water over the surface of a pond or the like including a water feed line, a water feed pipe having an upper end extending at least to the water surface, at least one nozzle mounted on said upper end of said pipe, and a pump for delivering water under pressure through said line and to said pipe whereby the water is forced out of said nozzle to form the water spray, the improvement comprising means for removably mounting a lamp at the juncture of said line and said pipe, said means including elbows and short pipe sections providing the juncture between said line and said pipe, said elbows forming an area adapted to be occupied by said lamp, and including a bracket supporting said lamp in said area, one of said elbows including a first arm connected to said light and a second arm extending at a right angle to said first arm, said second arm having an axis displaced to the side of the axis of said pipe, said bracket being connected to said first arm and including a member extending outwardly to intersect the axis of said pipe, the outermost end of said member including a cut-away section, said lamp being mounted in said cut-away section of said member beneath said pipe for removal from the construction without disconnecting the bracket from the first arm whereby light beams emitted by the lamp are directed substantially axially of said pipe, the spray of water emitted by said nozzle being emitted within said light beam.

2. In a water fountain construction for creating a spray of water over the surface of a pond or the like including a water feed line, a water feed pipe having an upper end extending at least to the water surface, at least one nozzle mounted on said upper end of said pipe, and a pump for delivering water under pressure through said line and to said pipe whereby the water is forced out of said nozzle to form the water spray, the improvement comprising means for removably mounting a lamp at the juncture of said line and said pipe, said means comprising a first elbow section having a first arm and a second arm extending at a right angle to said first arm, the first arm of the first elbow section being in communication with said water feed line, a series of connected short pipe sections, one of said pipe sections being in communication with the second arm of the first elbow section, and a second elbow section having a first arm and a second arm extending at a right angle to said first arm, the first arm of the second elbow section being in communication with one of said short pipe sections and the second arm being in communication with said water feed pipe, said elbows and pipe sections providing the juncture between said line and said pipe and forming an area adapted to be occupied by said lamp, and including a bracket removably supporting said lamp in said area, said bracket including a first member connected to the second arm of said first elbow section and a second member extending at a right angle to said first member to intersect the axis of said water feed pipe, the outermost end of said second member including a cutaway section, said lamp being mounted in said cutaway section of said second member beneath said pipe for removal from the construction without disconnecting the bracket from said second arm of the first elbow section whereby light beams emitted by the lamp are directed substantially axially of said pipe, the spray of water emitted by said nozzle being emitted within said light beam.

* * * * *